US011634964B2

(12) United States Patent
Fripp et al.

(10) Patent No.: US 11,634,964 B2
(45) Date of Patent: Apr. 25, 2023

(54) SWELLABLE RUBBER ELEMENT THAT ALSO CREATES A CUP PACKER

(71) Applicant: Halliburton Energy Services, Inc., Houston, TX (US)

(72) Inventors: Michael Linley Fripp, Carrollton, TX (US); Stephen Michael Greci, Little Elm, TX (US); Christopher Michael Pelto, Garland, TX (US); Matthew Arran Willoughby, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 575 days.

(21) Appl. No.: 16/478,553

(22) PCT Filed: Jul. 16, 2019

(86) PCT No.: PCT/US2019/042016

§ 371 (c)(1),
(2) Date: Jul. 17, 2019

(87) PCT Pub. No.: WO2021/010988

PCT Pub. Date: Jan. 21, 2021

(65) Prior Publication Data

US 2021/0363852 A1 Nov. 25, 2021

(51) Int. Cl.
*E21B 33/126* (2006.01)
*E21B 33/12* (2006.01)

(52) U.S. Cl.
CPC ..... *E21B 33/126* (2013.01); *E21B 33/1208* (2013.01); *E21B 2200/08* (2020.05)

(58) Field of Classification Search
CPC .. E21B 33/1208; E21B 33/122; E21B 33/124; E21B 33/126
See application file for complete search history.

(56) References Cited

U.S. PATENT DOCUMENTS

| | | | | |
|---|---|---|---|---|
| 6,640,893 | B1 | 11/2003 | Rummel et al. | |
| 7,431,098 | B2 | 10/2008 | Ohmer et al. | |
| 8,087,459 | B2 | 1/2012 | Caldwell et al. | |
| 8,752,625 | B2 | 6/2014 | Tibbles | |
| 2006/0000617 | A1 | 1/2006 | Harrall et al. | |
| 2009/0205841 | A1* | 8/2009 | Kluge | E21B 33/1208 166/387 |

(Continued)

FOREIGN PATENT DOCUMENTS

WO 2011060493 A1 5/2011

*Primary Examiner* — Kristyn A Hall
(74) *Attorney, Agent, or Firm* — Scott Richardson; Parker Justiss, P.C.

(57) ABSTRACT

Provided is an apparatus, as well as a method for establishing a seal between a mandrel and a borehole. The apparatus, in one aspect, includes a mandrel, and a packer, the packer including: a constrained portion coupled to the mandrel; and an unconstrained portion made of a swellable material and coupled to the constrained portion, wherein the unconstrained portion is free to move with respect to the mandrel. The apparatus, according to one aspect, further includes a spring positioned between the mandrel and the unconstrained portion and configured to urge the unconstrained portion away from the mandrel, the spring having a spring force less than a yield strength of the swellable material when the swellable material is in an unswelled condition.

18 Claims, 7 Drawing Sheets

(56) References Cited

U.S. PATENT DOCUMENTS

| | | | | |
|---|---|---|---|---|
| 2013/0056228 | A1 | 3/2013 | Gruetzmann et al. | |
| 2013/0263929 | A1 | 10/2013 | Atkins et al. | |
| 2014/0311751 | A1 | 10/2014 | Hallundbaek et al. | |
| 2014/0361497 | A1 | 12/2014 | Porta | |
| 2015/0144326 | A1* | 5/2015 | Solhaug | E21B 33/128 166/180 |
| 2015/0211323 | A1 | 7/2015 | Atkins et al. | |
| 2015/0267497 | A1 | 9/2015 | Atkins et al. | |
| 2016/0097252 | A1 | 4/2016 | Resink | |
| 2016/0376870 | A1 | 12/2016 | Roselier et al. | |

* cited by examiner

SWELLABLE RUBBER ELEMENT THAT ALSO CREATES A CUP PACKER

BACKGROUND

In the oil field, a packer may be used to seal an annulus between a pipe and a borehole or between two concentric pipes or in other similar arrangements. Some packers use swellable rubber elements that expand in the presence of a stimulus, such as oil, water, temperature, or other similar stimuli. Other packers include self-energizing sealing elements, defined for the purposes of this disclosure to mean sealing elements that tend to seal in response to the presence of pressure the sealing elements are intended to seal against. Providing a packer that includes a self-energizing swellable rubber element is a challenge.

DETAILED DESCRIPTION

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope of the appended claims. In particular, an element associated with a particular embodiment should not be limited to association with that particular embodiment but should be assumed to be capable of association with any embodiment discussed herein.

Figure 1A:
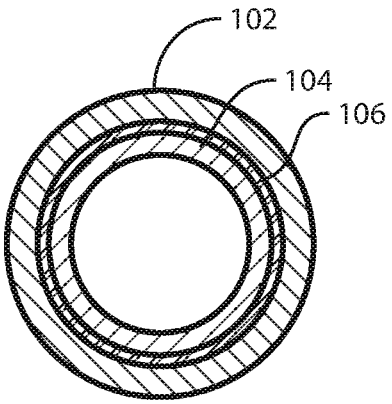
FIG. 1A is a cross-sectional view of an unswelled constrained swellable rubber seal around a mandrel.

FIG. 1A is a cross-sectional view of an unswelled constrained swellable rubber seal around a mandrel. Conventionally, a swellable rubber seal 102 is bonded to a mandrel 104 by an adhesive 106 or some other bonding technique.

Figure 1B:
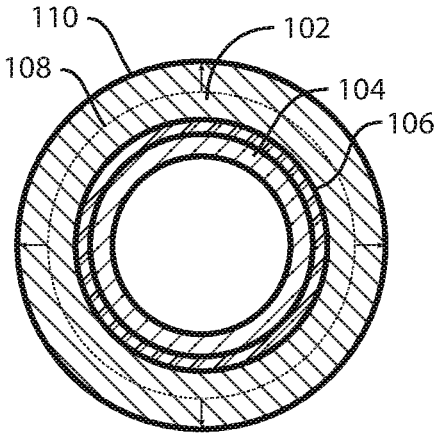
FIG. 1B is a cross-sectional view of the constrained swellable rubber seal around the mandrel of FIG. 1A after swelling occurs.

FIG. 1B is a cross-sectional view of the constrained swellable rubber seal around the mandrel of FIG. 1A after swelling occurs. After the constrained swellable rubber seal 102 is exposed to the swelling stimuli, such as water, oil, temperature, or other swelling stimuli, the constrained swellable seal 102 fills a larger volume with its outside diameter expanding from its original outside diameter 108 to a swollen outside diameter 110. The pressure holding capability of the constrained swellable seal 102 is related to the pressure that the constrained swellable seal 102 exerts outward in its swollen state illustrated in FIG. 1B. When the constrained swellable seal 102 is required to have a large amount of expansion (i.e., a large difference between original outside diameter 108 and new outside diameter 110), the outward pressure exerted by the constrained swellable seal 102 can be low and the sealing ability can be diminished. In some applications, the rubber will not reach the target diameter, much less have much sealing force at that diameter.

Figure 2A:
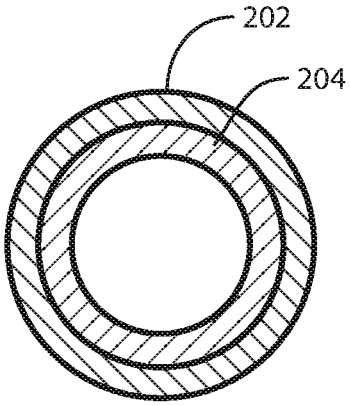
FIG. 2A is a cross-sectional view of an unswelled unconstrained swellable rubber seal around a mandrel.

FIG. 2A is a cross-sectional view of an unswelled unconstrained swellable rubber seal around a mandrel. In this example, an unconstrained swellable rubber seal 202 is positioned around a mandrel 204 but is not bonded to the mandrel 204. That is, unlike the example shown in FIGS. 1A and 1B, there is no adhesive 106 or other bond between the unconstrained swellable rubber seal 202 and the mandrel 204, which means that the unconstrained swellable rubber seal 202 is free to expand away from the mandrel 204.

Figure 2B:
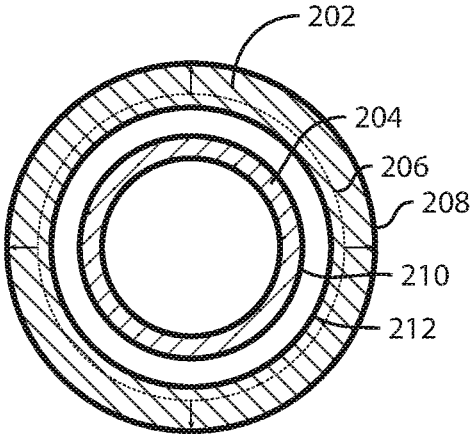
FIG. 2B is a cross-sectional view of the unconstrained swellable rubber seal around the mandrel of FIG. 2A after swelling occurs.

FIG. 2B is a cross-sectional view of the unconstrained swellable rubber seal around a mandrel of FIG. 1A after swelling occurs. After the unconstrained rubber seal 202 is exposed to the swelling stimuli, the outside diameter of the unconstrained rubber seal 202 expands from its original outside diameter 206 to a swollen outside diameter 208. The inside diameter also expands away from the mandrel 204 and away from the swollen outside diameter 208 from its original inside diameter 210 (roughly equal to the outside diameter of the mandrel 204) to a swollen inside diameter 212. As can be seen, while the unconstrained rubber seal 202 fills a larger volume in FIG. 2B as compared to FIG. 2A, the unconstrained rubber seal 202 has pulled away from the mandrel 204. The outside diameter 208 of the unconstrained rubber seal 202 reaches a large diameter but the inside diameter 212 does not seal and the arrangement shown in FIGS. 2A and 2B would have no pressure holding capability.

The apparatus disclosed herein uses a swellable rubber element to create a cup-like seal. A swellable rubber element is partially constrained so that part of the swellable rubber element remains intimately connected to the mandrel to which the swellable rubber element is coupled and part of the swellable rubber element expands away from the mandrel to fill a greater range of annular space, such as the annular space between a pipe and a borehole wall or between two concentric pipes, than would be possible with a conventional swellable rubber seal, such as described above in connection with FIGS. 1A, 1B, 2A, and 2B. The part of the swellable rubber element that expands away from the mandrel is self-energizing, which allows for sealing over a larger pressure differential.

Figure 3:
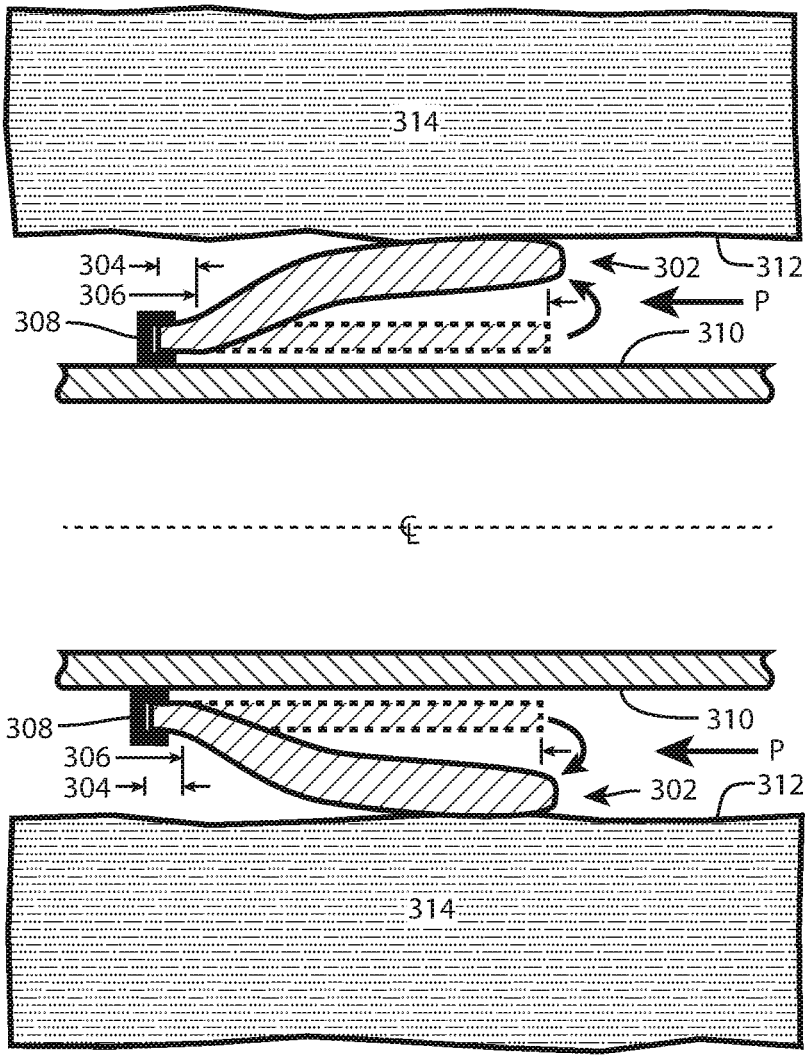
FIG. 3 is a cross-sectional view of a swellable rubber element that is partially constrained.

FIG. 3 is a cross-sectional view of a swellable rubber element that is partially constrained. A swellable rubber element 302 (shown pre-swelling in dashed lines and post-swelling in solid lines) includes a constrained portion 304 and an unconstrained portion 306. The constraint 308 on the constrained portion 304 is shown symbolically in FIG. 3. Example techniques for constraining the constrained portion are discussed below in connection with FIGS. 4-7.

The constrained portion 304 maintains a seal on a mandrel 310. The unconstrained portion 306 swells open in the presence of a stimulus and creates contact on a borehole wall 312 in a subterranean formation 314. The configuration illustrated in FIG. 3 creates a cup packer in which applied pressure P further energized the seal. As such, the configuration illustrated in FIG. 3 is a self-energizing swellable wellbore isolation device. The centerline depicted in FIG. 3 is the longitudinal centerline of the mandrel 310.

The concept of a self-energizing swellable wellbore isolation device has been demonstrated in lab-scale testing. The swellable rubber element was captured on the left (referring to FIG. 3) with a metal hoop. This left side maintained an intimate connection to the inside mandrel. The right side was unconstrained. The right side expanded outward, increasing in diameter, until an intimate connection was made with an outer tubing. If the swellable rubber element had been bonded to the inner pipe along its entire length, it would not have had sufficient expansion to reach the outer pipe. However, by using this partially bonded configuration, the right side was able to bridge the space and to create a seal. The new seal is a self-energizing seal so that applied pressure would push with greater force on the swellable rubber element and increase the sealing pressure.

Figure 4:
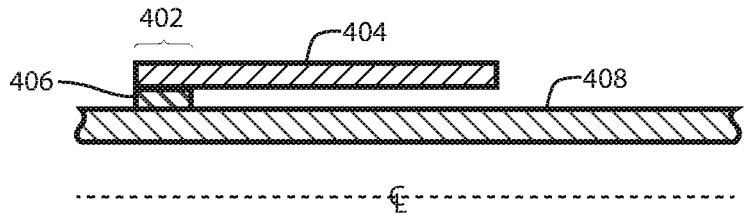
FIG. 4 is a cross-sectional view of a swellable rubber element bonded to a mandrel.

FIG. 4 is a cross-sectional view of a swellable rubber element bonded to a mandrel. A constrained portion 402 of a swellable rubber element 404 may be bonded, such as by an adhesive or curing agent 406 or the like, to a mandrel 408. The centerline depicted in FIG. 4 is the longitudinal centerline of the mandrel 408.

Figure 5:
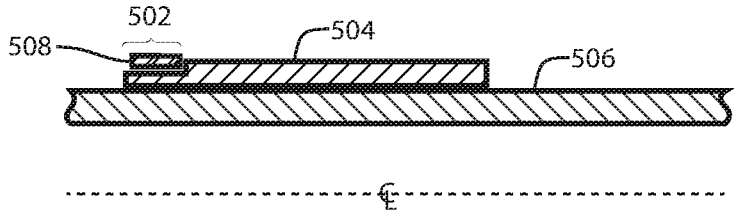
FIG. 5 is a cross-sectional view of a swellable rubber element captured by a hoop.

FIG. 5 is a cross-sectional view of a swellable rubber element captured by a hoop. A constrained portion 502 of a swellable rubber element 504 may be captured against a mandrel 506 by a capture device 508, such as a hoop. The centerline depicted in FIG. 5 is the longitudinal centerline of the mandrel 506.

Figure 6:
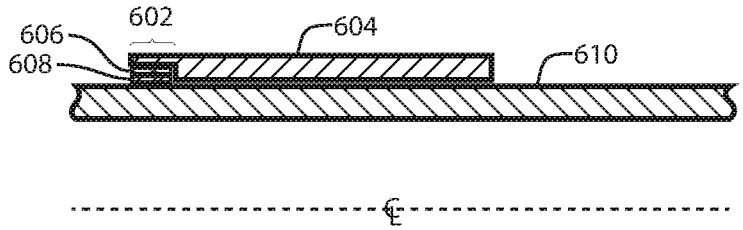
FIG. 6 is a cross-sectional view of a swellable rubber element bonded to a slide.

FIG. 6 is a cross-sectional view of a swellable rubber element bonded to a slide. A constrained portion 602 of a swellable rubber element 604 may be bonded, by an adhesive 606 or the like, to a slide 608 (or sleeve) that at least partially extends around a mandrel 610. The swellable rubber element 604 may be bonded face-to-face to the slide 608, as shown in FIG. 6, or an edge of the swellable rubber element 604 may be bonded to an edge of the slide 608 (not shown). The centerline depicted in FIG. 6 is the longitudinal centerline of the mandrel 610.

Figure 7:
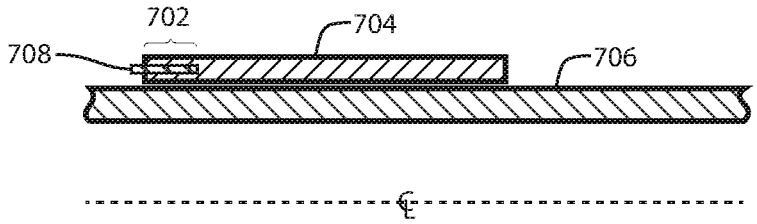
FIG. 7 is a cross-sectional view of a swellable rubber element captured by a hoop through a swellable rubber element.

FIG. 7 is a cross-sectional view of a swellable rubber element captured by a hoop through a swellable rubber element. A constrained portion 702 of a swellable rubber element 704 may be captured against a mandrel 706 by a capture device 708, such as a hoop, that passes through the constrained portion 702. The capture device 708 may be partially enclosed by the swellable rubber element 704, as shown in FIG. 11, or it may be fully enclosed by the swellable rubber element 704. The centerline depicted in FIG. 7 is the longitudinal centerline of the mandrel 706.

The example techniques for constraining the constrained portion illustrated in FIGS. 4-7 are merely examples. Other similar techniques would be apparent to a person of ordinary skill in the relevant art. Further, while the example techniques for constraining the constrained portion illustrated in FIGS. 4-7 employ mechanisms to pull the constrained portion toward the mandrel, other techniques may push the constrained portion into contact with the mandrel. For example, a member extending from a tube concentric with the mandrel or from a borehole wall may push the constrained portion into contact with the mandrel.

Figure 8A:
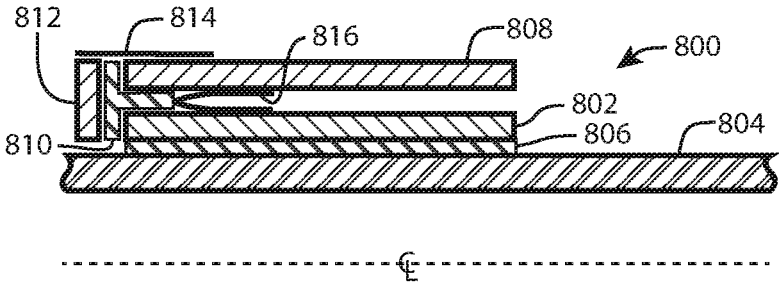
FIG. 8A is a cross-sectional view of a cup packer including a spring.

FIG. 8A is a cross-sectional view of a cup packer including a spring. A cup packer 800 includes a bonded rubber element 802 that is bonded to a mandrel 804 by a bonding agent 806, such as an adhesive. A swellable rubber element 808 may be coupled to the bonded rubber element 802 by, for example, an adhesive 810. The same adhesive 810 (or a different adhesive) may bond an optional first reinforcement 812 and/or an optional second reinforcement 814 to the bonded rubber element 802 and the swellable rubber element 808. A spring 816 may be placed between the bonded rubber element 802 and the swellable rubber element 808 to assist in energizing the cup formed by the swellable rubber element 808. The optional first reinforcement 812 and optional second reinforcement 814 help increase the sealing pressure of the cup formed by the swellable rubber element 808. The bonded rubber layer 802 may be constructed from a swellable rubber or a non-swellable rubber. The centerline depicted in FIG. 8A is the longitudinal centerline of the mandrel 804.

A similar spring may be placed between the swellable rubber elements 404, 504, 604, and 704 and the respective mandrels 408, 506, 610, 706 for the examples illustrated in FIGS. 4-7.

Figure 8B:
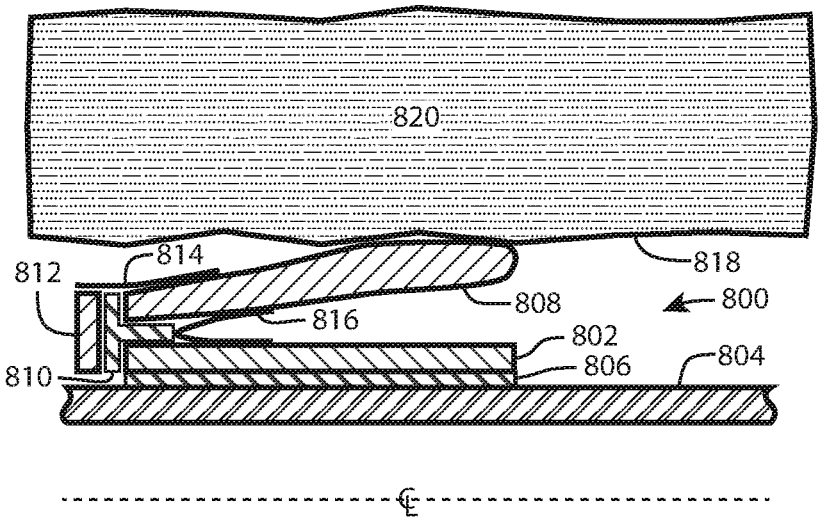
FIG. 8B is a cross-sectional view of the cup packer including the spring after energizing the swellable rubber element into a cup seal.

FIG. 8B is a cross-sectional view of the cup packer including the spring of FIG. 8A after energizing the cup packer into a cup seal. As can be seen, the spring 816 has assisted in pushing the swellable rubber element 808 into a cupped position against a borehole wall 818 through a formation 820. In some conditions, the force of the spring is selected so that the spring force is less than the yield strength of the swellable rubber 808 when the swellable rubber is in its unswelled condition (FIG. 8A). The centerline depicted in FIG. 8B is the longitudinal centerline of the mandrel 804.

In situations where a packer element is cantilevered, such as the swellable rubber elements 404, 504, 604, 704, and 808 in respective FIGS. 4-7, 8A, and 8B, the cantilevered element may be temporarily constrained with a dissolvable material (not shown) during, for example, run-in. When the packer is in a desired position, the dissolvable material may degrade and allows the cantilevered element to perform as previously described. The dissolvable material may be a metal, such as aluminum, magnesium, and zinc. The metal can be alloyed with other elements in order to change tensile strength, strain to failure, or dissolution rate. For example, magnesium can be alloyed with aluminum to increase strength and can be alloyed with copper to accelerate dissolution. The dissolvable material may be a degradable plastic, such as an aliphatic polyester, specifically polylactic acid (PLA) plastic, a polyglycolide (PGA) plastic. The dissolvable material may be a degradable elastomer such as urethane, thermoplastic urethane (TPU), and thiol.

Figure 9A:
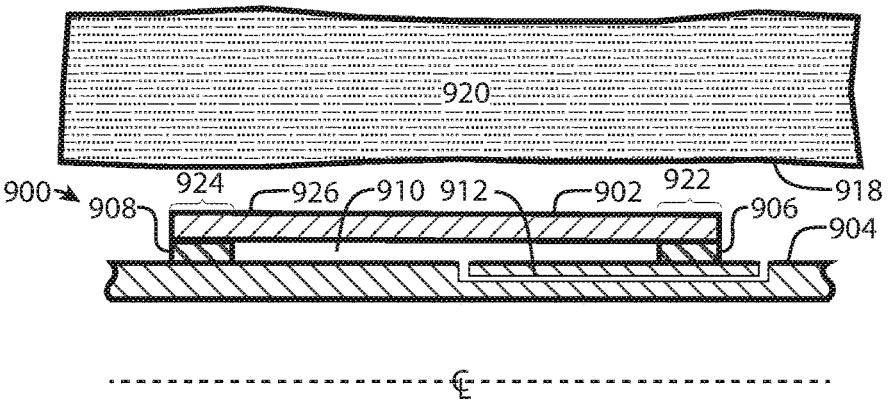
FIG. 9A is a cross-sectional view of a packer with a swellable rubber element bound at both ends and including a pressure port.

FIG. 9A is a cross-sectional view of a packer with a swellable rubber element bound at both ends and including a pressure port. A packer 900 may include a swellable rubber element 902 that may be bonded to a mandrel 904 by bonding agents 906, 908, such as adhesives, at or near (i.e., within 10 percent of the length of the swellable rubber element 902) both ends of the swellable rubber element 902. A toroidal chamber 910 may be formed between the swellable rubber element 902 and the mandrel 904. A pressure channel 912 may extend from outside the toroidal chamber 910 to inside the toroidal chamber 910. The swellable rubber element 902 may be longitudinally (i.e., in the direction the mandrel 904 extends) longer than the swellable rubber elements 404, 504, 604, 704, 808 illustrated in FIGS. 4-7, 8A, and 8B, which enhances the diameter change of the swellable rubber element 902 upon activation. The pressure channel 912 may cause the packer 900 to be self-energizing. The centerline depicted in FIG. 9A is the longitudinal centerline of the mandrel 904.

Figure 9B:
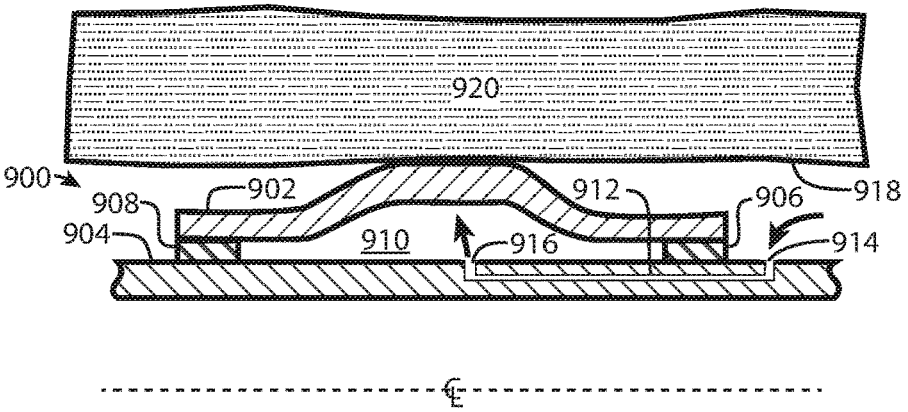
FIG. 9B is a cross-sectional view of the packer of FIG. 9A after energization.

FIG. 9B is a cross-sectional view of the packer of FIG. 9A after energization. As can be seen, pressure enters the pressure channel 912 at an outside port 914 and enters the toroidal chamber 910 at an inside port 916, helping to energize the swellable rubber element 902 against a borehole wall 918 through a formation 920. The centerline depicted in FIG. 9B is the longitudinal centerline of the mandrel 904.

Figure 10:
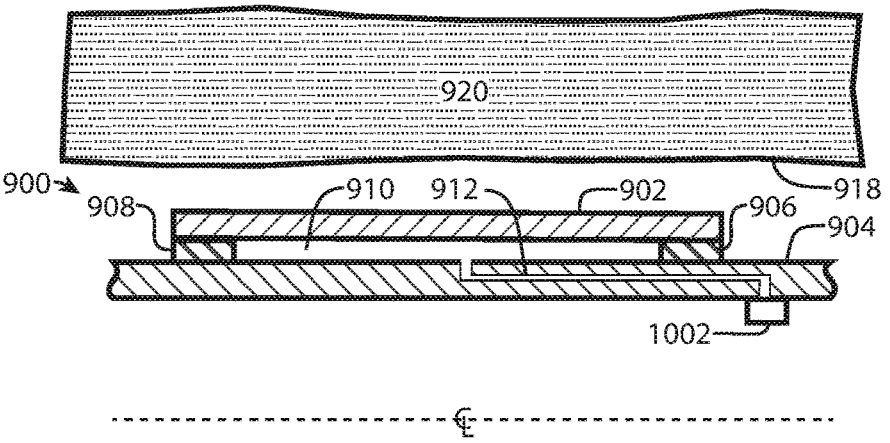
FIG. 10 is a cross-sectional view of a packer with a swellable rubber element bound at both ends and including a pressure port and a pressure source located within a mandrel.

FIG. 10 is a cross-sectional view of a packer with a swellable rubber element bound at both ends and including a pressure port and a pressure source located within a mandrel. The source of pressure 1002 to assist in energizing the swellable rubber element 902 through the pressure channel 912 may be outside the mandrel, as shown in FIGS. 9A and 9B, or it may be within the mandrel 904, as shown in FIG. 10 or within the wall of the mandrel 904 (not shown). The centerline depicted in FIG. 10 is the longitudinal centerline of the mandrel 904.

In FIGS. 9A, 9B, and 10, the swellable rubber element 902 has a first constrained portion 922 (labeled in FIG. 9A) adjacent to the bonding agent 906, a second constrained portion 924 adjacent to the bonding agent 908 and an unconstrained portion 926 between the bonding agent 906 and the bonding agent 908 that may be integral with the first constrained portion 922 and the second constrained portion 924.

Figure 11A:
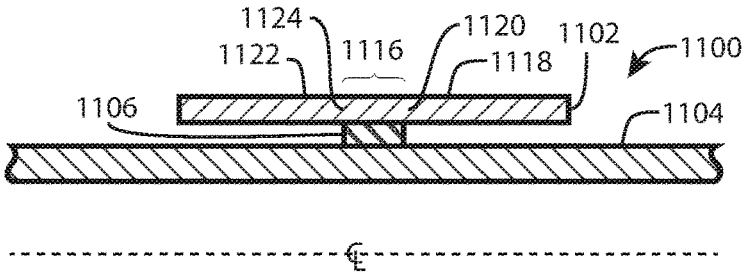
FIG. 11A is a cross-sectional view of a packer with a swellable rubber element bound at or near the center.

FIG. 11A is a cross-sectional view of a packer with a swellable rubber element bound at or near the center. A packer 1100 includes a swellable rubber element 1102 bonded to a mandrel 1104 by a bonding agent 1106, such as an adhesive, at a location away from the ends of the swellable rubber element 1102, for example at or near (i.e., within 10 percent of the length of the swellable rubber element 1102) the center of the swellable rubber element 1102. The centerline depicted in FIG. 11A is the longitudinal centerline of the mandrel 1104.

Figure 11B:
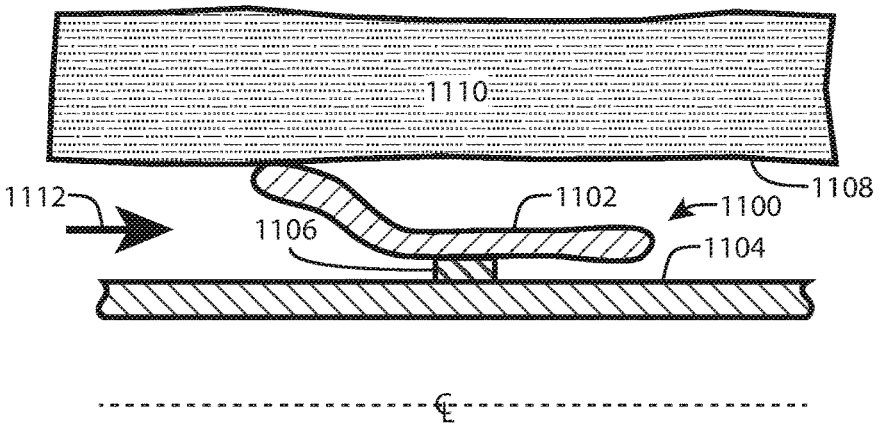
FIG. 11B is a cross-sectional view of the packer of FIG. 11A energized by pressure from a first direction.

FIG. 11B is a cross-sectional view of the packer of FIG. 11A energized by pressure from a first direction. When the swellable rubber element 1102 is activated and a pressure symbolized by the heavy arrow 1112 is applied, the swellable rubber element 1102 forms a cup seal against a borehole wall 1108 penetrating a formation 1110, where the cup seal resists pressure from the direction of the arrow 1112. The centerline depicted in FIG. 11B is the longitudinal centerline of the mandrel 1104.

Figure 11C:
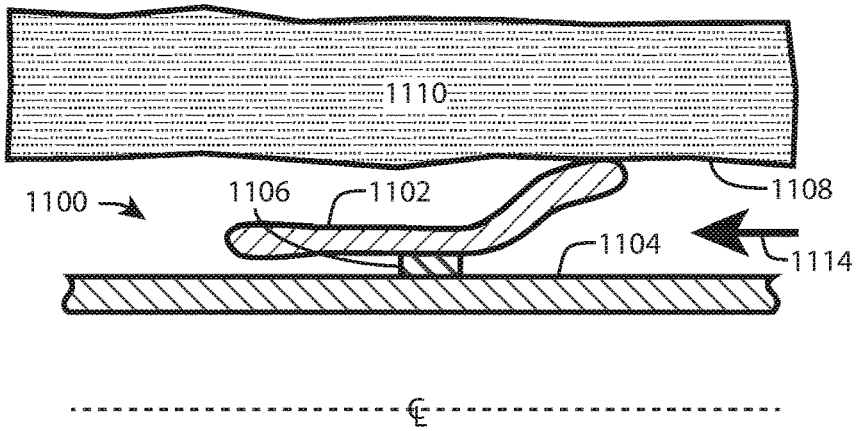
FIG. 11C is a cross-sectional view of the packer of FIG. 11A energized by pressure from a second direction.

FIG. 11C is a cross-sectional view of the packer of FIG. 11A energized by pressure from a second direction. When the swellable rubber element 1102 is activated and a pressure symbolized by the heavy arrow 1114 is applied, the swellable rubber element 1102 forms a cup seal against the borehole wall 1108 penetrating the formation 1110, where the cup seal resists pressure from the direction of the arrow 1114. The centerline depicted in FIG. 11C is the longitudinal centerline of the mandrel 1104.

In FIGS. 11A, 11B, and 11C, the swellable rubber element 1102 includes a constrained portion 1116 (labeled in FIG. 11A) adjacent to bonding agent 1106. The swellable rubber element 1102 has a first unconstrained portion part 1118 integral with a first end 1120 of the constrained portion 1116 and a second unconstrained portion part 1122 integral with a second end 1124 of the constrained portion 1116

Figure 12:
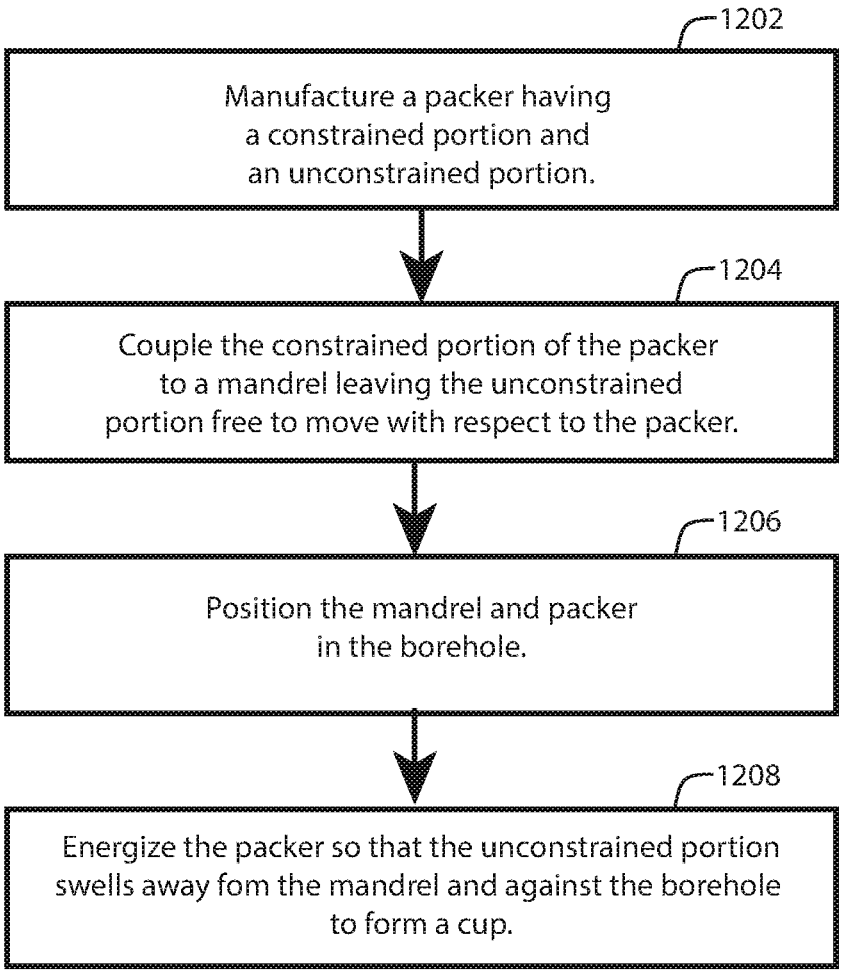
FIG. 12 is a flow chart describing a method for establishing a seal between a mandrel and a borehole.

FIG. 12 is a flow chart describing a method for establishing a seal between a mandrel and a borehole. A packer is manufactured having a constrained portion and an unconstrained portion (block 1202). The unconstrained portion is made of a swellable material and is coupled to the constrained portion. The constrained portion of the seal element is coupled to the mandrel leaving the unconstrained portion free to move with respect to the mandrel (block 1204). The mandrel and packer are positioned in the borehole (block 1206). The packer is energized so that the unconstrained portion swells away from the mandrel and against the borehole to form a cup (block 1208).

The swellable rubber element 302, 404, 504, 604, 704, 808, 902, 1102 may include a swellable rubber bonded to a non-swelling rubber, a water-swelling rubber bonded to an oil-swelling rubber, and/or a water-swelling rubber bonded with a water-contracting rubber. The swellable rubber element 302, 404, 504, 604, 704, 808, 902, 1102 may be created from a swelling part and a non-swelling part by an adhesive or by in-mold bonding, or by another similar technique. The constrained portion 304, 402, 502, 602, 702, 922, 924, 1116 of the swellable rubber element 302, 404, 504, 604, 704, 902, 1102 may be made from a non-swelling material.

The swellable rubber element 302, 404, 504, 604, 704, 808, 902, 1102 may be made of an oil swellable rubber, such as ethylene propylene diene terpolymer (EPDM) rubber. The swellable rubber element 302, 404, 504, 604, 704, 808, 902, 1102 may be made of a water-swellable rubber with super absorbant additives (SAP) that will swell in water. The swellable rubber element 302, 404, 504, 604, 704, 808, 902, 1102 may be made of thermal swelling elastomers that use the thermal expansion from the temperature change in order to change size, such as rubber that has been compounded with paraffin wax, which will expand when the wax melts. The swellable rubber element 302, 404, 504, 604, 704, 808, 902, 1102 may include reinforcing material, such as fibers longitudinally aligned so as not to interfere with swelling but to provide stiffening.

The non-swelling rubber elements 802 or the constrained portions of the swellable rubber element 302, 404, 504, 604, 704, 808, 902, 1102 may be made of Nitrile, hydrogenated nitrile butadiene rubber (HNBR), fluro-elastomers (FKM), perfluoro-elastomers (FFKM), and/or natural rubbers.

Further examples consistent with the present teachings are set out in the following numbered clauses.

Clause 1. An apparatus comprising:

a mandrel;

a packer having:

a constrained portion coupled to the mandrel, and an unconstrained portion made of a swellable material and coupled to the constrained portion, wherein the unconstrained portion is free to move with respect to the mandrel.

Clause 2. The apparatus of clause 1 wherein the constrained portion of the packer has an outside diameter and is coupled to the mandrel by one or more of: (a) a bond between the constrained portion and the mandrel, (b) a hoop against the outside diameter of the constrained portion to capture the constrained portion against the mandrel, (c) a bond between the constrained portion and a slide around the mandrel, (d) a hoop embedded in the constrained portion to capture the constrained portion against the mandrel.

Clause 3. The apparatus of any preceding clause wherein the unconstrained portion is made from a material selected from the group consisting of a water-swelling rubber and an oil-swelling rubber.

Clause 4. The apparatus of any preceding clause wherein the constrained portion is made from a material selected from the group consisting of a non-swelling material, a water-swelling rubber, a water-contracting rubber, and an oil-swelling rubber.

Clause 5. The apparatus of any preceding clause wherein the constrained portion is bonded to the unconstrained portion by one or more of: (a) an adhesive bond between the constrained portion and the unconstrained portion, or (b) an in-mold bond between the constrained portion and the unconstrained portion.

Clause 6. The apparatus of any preceding clause further comprising a spring to urge the unconstrained portion away from the mandrel.

Clause 7. The apparatus of any preceding clause wherein the constrained portion is integral with the unconstrained portion.

Clause 8. The apparatus of any preceding clause wherein the unconstrained portion has a first unconstrained portion part integral with a first end of the constrained portion and a second unconstrained portion part integral with a second end of the constrained portion.

Clause 9. The apparatus of any preceding clause wherein the constrained portion has a first constrained portion part integral with a first end of the unconstrained portion and a second constrained portion part integral with a second end of the unconstrained portion.

Clause 10. The apparatus of clause 9 further comprising a pressure port into a space between the mandrel and the unconstrained portion through one or more of: the mandrel, the unconstrained portion, the constrained portion, or a coupling between the unconstrained portion and the first end of the unconstrained portion.

Clause 11. The apparatus of clause 9 further comprising a pressure source coupled to the pressure port, wherein the pressure source is one of: internal to the mandrel or outside the mandrel.

Clause 12. The apparatus of any preceding clause further comprising reinforcing material embedded in the unconstrained portion.

Clause 13. A method for establishing a seal between a mandrel and a borehole comprising:

manufacturing a packer having:

a constrained portion, and an unconstrained portion made of a swellable material and coupled to the constrained portion;

coupling the constrained portion of the seal element to the mandrel leaving the unconstrained portion free to move with respect to the mandrel;

positioning the mandrel and seal element in the borehole;

energizing the packer so that the unconstrained portion swells away from the mandrel and against the borehole to form a cup.

Clause 14. The method of clause 13 further comprising: binding the unconstrained portion with a dissolvable material.

Clause 15. The method of any of clauses 13-14 wherein energizing the packer includes exposing the unconstrained portion to one or more of: water-based fluid, oil-based fluid, or heat.

Clause 16. The method of any of clauses 13-15 wherein energizing the packer comprises pressurizing a space between the unconstrained portion and the mandrel.

Clause 17. The method of any of clauses 13-16 wherein coupling the constrained portion of the packer to the mandrel includes one or more of: bonding the constrained portion to the mandrel, capturing the constrained portion against the mandrel with a hoop against an outside diameter of the constrained portion, bonding the constrained portion to a sleeve around the mandrel, and capturing the constrained portion against the mandrel with a hoop embedded in the constrained portion.

Clause 18. The method of any of clauses 13-17 further comprising providing a spring between the mandrel and the unconstrained portion.

Clause 19. An apparatus comprising:

a mandrel;

a packer having:

a constrained portion made of a swellable material coupled to the mandrel, and an unconstrained portion made of a swellable material and coupled to the constrained portion, wherein the unconstrained portion is free to move with respect to the mandrel.

Clause 20. The apparatus of clause 19 wherein the constrained portion is integral with the unconstrained portion.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a mandrel;

a packer, the packer including having:

a constrained portion coupled to the mandrel; and an unconstrained portion made of a swellable material and coupled to the constrained portion, wherein the unconstrained portion is free to move with respect to the mandrel; and a spring positioned between the mandrel and the unconstrained portion and configured to urge the unconstrained portion away from the mandrel, the spring having a spring force less than a yield strength of the swellable material when the swellable material is in an unswelled condition.

2. The apparatus of claim 1 wherein the constrained portion of the packer has an outside diameter and is coupled to the mandrel by one or more of: (a) a bond between the constrained portion and the mandrel, (b) a hoop against the outside diameter of the constrained portion to capture the constrained portion against the mandrel, (c) a bond between the constrained portion and a slide around the mandrel, (d) a hoop embedded in the constrained portion to capture the constrained portion against the mandrel.

3. The apparatus of claim 1 wherein the unconstrained portion is made from a material selected from the group consisting of a water-swelling rubber and an oil-swelling rubber.

4. The apparatus of claim 1 wherein the constrained portion is made from a material selected from the group consisting of a non-swelling material, a water-swelling rubber, a water-contracting rubber, and an oil-swelling rubber.

5. The apparatus of claim 1 wherein the constrained portion is bonded to the unconstrained portion by one or more of: (a) an adhesive bond between the constrained portion and the unconstrained portion, or (b) an in-mold bond between the constrained portion and the unconstrained portion.

6. The apparatus of claim 1 wherein the constrained portion is integral with the unconstrained portion.

7. The apparatus of claim 1 wherein the unconstrained portion has a first unconstrained portion part integral with a first end of the constrained portion and a second unconstrained portion part integral with a second end of the constrained portion.

8. The apparatus of claim 1 wherein the constrained portion has a first constrained portion part integral with a first end of the unconstrained portion and a second constrained portion part integral with a second end of the unconstrained portion.

9. The apparatus of claim 8 further comprising a pressure port into a space between the mandrel and the unconstrained portion through one or more of: the mandrel, the unconstrained portion, the constrained portion, or a coupling between the unconstrained portion and the first end of the unconstrained portion.

10. The apparatus of claim 8 further comprising a pressure source coupled to the pressure port, wherein the pressure source is one of: internal to the mandrel or outside the mandrel.

11. The apparatus of claim 1 further comprising reinforcing material embedded in the unconstrained portion.

12. A method for establishing a seal between a mandrel and a borehole comprising:

manufacturing a packer having:

a constrained portion, and an unconstrained portion made of a swellable material and coupled to the constrained portion;

coupling the constrained portion of a seal element to the mandrel leaving the unconstrained portion free to move with respect to the mandrel;

positioning the mandrel and seal element in the borehole;

providing a spring between the mandrel and the unconstrained portion, the spring configured to urge the unconstrained portion away from the mandrel and having a spring force less than a yield strength of the swellable material when the swellable material is in an unswelled condition; and energizing the packer so that the unconstrained portion swells away from the mandrel and against the borehole to form a cup.

13. The method of claim 12 further comprising:

binding the unconstrained portion with a dissolvable material.

14. The method of claim 12 wherein energizing the packer includes exposing the unconstrained portion to one or more of: water-based fluid, oil-based fluid, or heat.

15. The method of claim 12 wherein energizing the packer comprises pressurizing a space between the unconstrained portion and the mandrel.

16. The method of claim 12 wherein coupling the constrained portion of the packer to the mandrel includes one or more of: bonding the constrained portion to the mandrel, capturing the constrained portion against the mandrel with a hoop against an outside diameter of the constrained portion, bonding the constrained portion to a sleeve around the mandrel, and capturing the constrained portion against the mandrel with a hoop embedded in the constrained portion.

17. An apparatus comprising:

a mandrel;

a packer, the packer including:

a constrained portion made of a swellable material coupled to the mandrel, and an unconstrained portion made of a swellable material and coupled to the constrained portion, wherein the unconstrained portion is free to move with respect to the mandrel; and a spring positioned between the mandrel and the unconstrained portion and configured to urge the unconstrained portion away from the mandrel, the spring having a spring force less than a yield strength of the swellable material when the swellable material is in an unswelled condition.

18. The apparatus of claim 17 wherein the constrained portion is integral with the unconstrained portion.

* * * * *